United States Patent [19]

Migeon

[11] 4,417,819

[45] Nov. 29, 1983

[54] WATCHBAND LIGHT ATTACHMENT FOR A WRISTWATCH

[75] Inventor: Jean P. Migeon, Recologne, France

[73] Assignee: Timex Corporation, Waterbury, Conn.

[21] Appl. No.: 394,032

[22] Filed: Jun. 30, 1982

[51] Int. Cl.[3] ..... G04B 19/30

[52] U.S. Cl. ..... 368/67; 368/227

[58] Field of Search ..... 368/67, 82, 223–225, 368/227

[56] References Cited

U.S. PATENT DOCUMENTS

| | | | |
|---|---|---|---|
| 3,025,662 | 3/1962 | Fleishman et al. | 368/67 |
| 3,116,883 | 1/1964 | Meugebauer | 368/227 |
| 3,224,184 | 12/1965 | Brien | 368/227 |
| 3,681,587 | 8/1972 | Brien | 368/227 |
| 3,729,923 | 5/1973 | Brigliano et al. | 368/225 |
| 3,783,604 | 1/1974 | Florent et al. | 368/67 |

FOREIGN PATENT DOCUMENTS

| | | | |
|---|---|---|---|
| 2263999 | 10/1973 | Fed. Rep. of Germany | 368/67 |
| 53-2546 | 3/1978 | Japan | 368/227 |

*Primary Examiner*—Vit W. Miska

*Attorney, Agent, or Firm*—William C. Crutcher

[57] ABSTRACT

An illumination device (7, 23) for a wristwatch (1), having a completely self-contained power source (15) and illuminating lamp (17, 29) which is carried on the watchband (6). A flexible wall (21, 31) permits contact between lamp terminals (20, 35) and battery terminals to close the circuit when the device is manually actuated. An overhanging portion (8, 26) extends beyond the attachment (28) of the band to the wristwatch, so that the lamp (17, 29) may illuminate the face (4) of the wristwatch.

7 Claims, 5 Drawing Figures

WATCHBAND LIGHT ATTACHMENT FOR A WRISTWATCH

BACKGROUND OF THE INVENTION

This invention relates generally to illumination devices for wristwatches, and more particularly to an exterior illumination device carried by the watchband.

Various types of illumination devices have been proposed for wristwatches to enable reading the time under poor light conditions. Such devices usually take the form of small incandescent bulbs powered by a battery and arranged inside the case of the wristwatch, assisted by light pipes or reflectors to enable the numerals on the dial be seen. It has been proposed to carry the small button cell or battery outside the watchcase in a special attachment connected to the watchband as shown, for example, in U.S. Pat. No. 3,018,614 issued Jan. 30, 1962 and U.S. Pat. No. 3,224,184 issued Dec. 21, 1965, both in the name of A. Brien. The Brien patents show the incandescent bulb carried in the watch crystal, connected to the battery by lead-in wires, and operated by a switch. U.S. Pat. No. 3,025,662 issued Mar. 20, 1962 to Fleishman et al discloses a hinged cover containing an incandescent lamp for illuminating the dial, having a switch making contact with a power source carried on the watch strap when the hinged cover is opened.

U.S. Pat. No. 3,729,923 issued May 1, 1973 to Brigliano et al discloses an incandescent bulb carried on the watchcase and connected to a battery in an attachment connected between the watchband and the case by means of lead wires. A deformable or flexible wall allows the circuit to be closed to illuminate the dial by pressing the flexible wall.

The foregoing arrangements, because of lead wires passing between the power source in the watchband attachment and the incandescent bulb in the case or crystal are subject to possible malfunction, due to breakage of the wires caused by repetitive movement between the case and the attachment. Also, the arrangements shown are not easily removable or detached from the wristwatch, and thereby preclude the user from having the option of either utilizing the illumination device or removing it.

Accordingly, one object of the present invention is to provide a completely self-contained illumination device which is used, or not, at the wearer's option.

Another object of the invention is to provide improved illumination device with no lead wires passing between moving parts of the watch.

DRAWINGS

The invention, both as to organization and method of practice, together with further objects than advantages thereof, will best be understood by reference to the following description, taken in connection with the accompanying drawings, in which:

FIG. 1 is a perspective drawing of a wristwatch having the improved illumination device in its preferred form, FIG. 2 is an exploded perspective view of the FIG. 1 illumination device, button cell and a portion of the watchstrap, inverted from the FIG. 1 position, FIG. 3 is a transverse cross section elevation drawing of the illumination device assembled with button cell on the strap of the wristwatch, taken along lines 3—3 of FIG. 1, FIG. 4 is a perspective view of a modified form of the invention, and FIG. 5 is a elevation drawing, in longitudinal cross section taken along lines 5—5 of FIG. 4, showing the details of the modified illumination device.

SUMMARY OF THE INVENTION

Briefly stated, the invention comprises the improvement in a wristwatch having a case containing a timepiece face portion to be illuminated and a watchband having two attachment ends, at least the first of which is attached to said case, said improvement comprising a self-contained illumination device removably held by the second attachment end of the watchband and having an overhanging portion extending beyond said case attachment lugs and carrying a lamp arranged to illuminate said timepiece face portion, said illumination device defining a cavity containing a battery having terminals, pair of lamp terminals connected to said lamp and disposed in the cavity, a portion of the cavity wall being flexible and adapted to permit contact between battery terminals and lamp terminals when the device is manually actuated to flex the flexible wall.

DESCRIPTION OF THE PREFERRED EMBODIMENT

Figure 1:
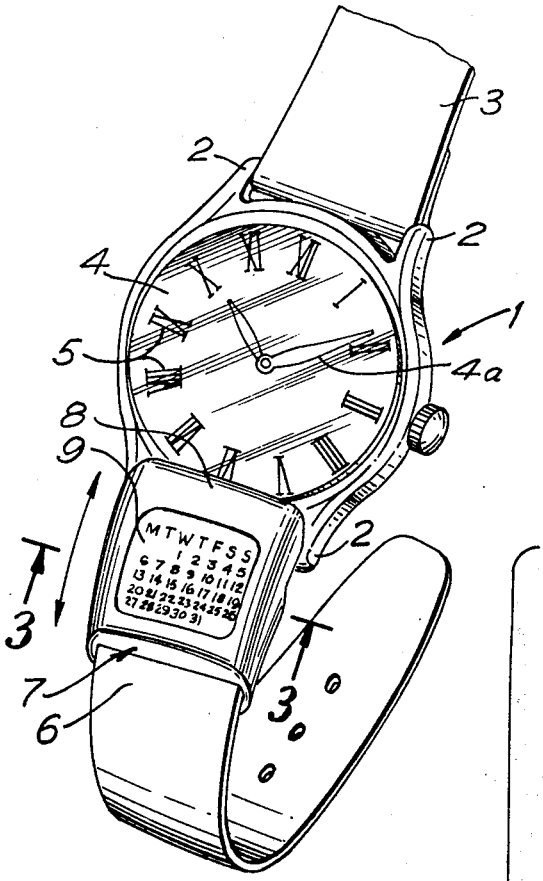

Referring now to FIG. 1 of the drawing, a wristwatch comprises a timepiece 1 of conventional construction with space attachment lugs 2 for removably attaching at least one attachment end 3 of a conventional watchstrap, using "spring bars". The watchcase includes a conventional face portion or dial 4, with timekeeping indicia 5 and timekeeping hands 4*a*. However, the invention is equally applicable to a solid state digital watch. In the preferred embodiment of FIG. 1, the other attachment end 6 of the watchband is similarly attached to lugs 2 in the conventional manner.

According to the present invention, a self-contained illumination device 7 is removably held by the watchband with flanges, by sliding it over the end of the strap to the position shown. As will be further amplified, the illumination device 7 includes an overhanging portion 8, which extends beyond the springbar attachment at lugs 2 and also carries the light source. Optionally, the illumination device 7 may incorporate an insert of plastic material for holding miscellaneous information such as a calendar, pictures, phone numbers, or a writing pad.

Figure 2:
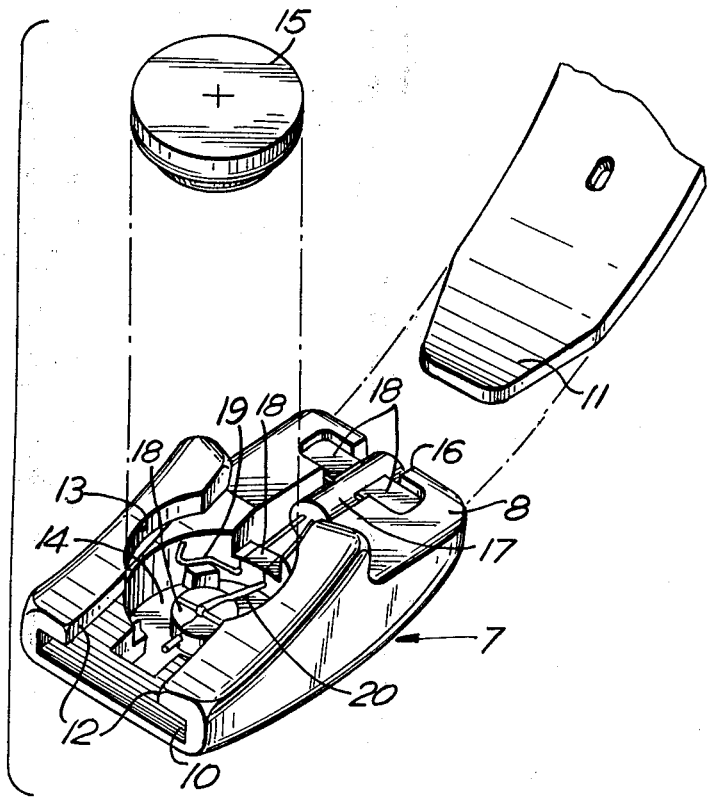

Referring now to FIG. 2 of the drawing, the underside of the illumination device shows it to comprise a main body with a longitudinal passage 10 shaped to receive the tongue 11 of the watchstrap. The strap is retained by the two flanges 12. The flanges include a cutout portion 13 aligned with a cavity 14, adapted to receive a conventional button cell 15, with conventional battery terminals at opposite ends thereof.

Illumination device 7 includes a overhanging portion 8 forming a slot 16 carrying a miniature incandescent bulb 17. A stationary lamp terminal 19 and a movable lamp terminal 20 are disposed in cavity 14 and connected to the lamp by means of lead wires. The bulb and lamp terminals may be retained in place by any suitable means such as a warm forming operation providing upsetting tabs indicated at 18, or other methods such as ultrasonic welding or gluing.

Figure 3:
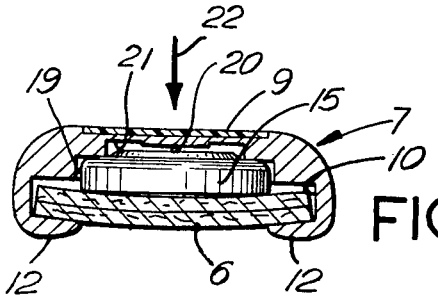

Referring to the cross sectional drawing of FIG. 3, it can be seen that cavity 15 includes a thin flexible wall portion 21 on which the movable lamp terminal 20 is disposed, in spaced relationship from the battery terminal. Pressure on the flexible wall as shown by arrow 22 closes the contact and lights the incandescent lamp to illuminate the dial. Since the overhanging portion 8 is arranged to extend beyond point of attachment to the case and to carry the lamp above the timepiece dial, it will provide illumination for the face portion. Yet the illumination device 7 is completely self-contained, carrying the power source, lead wires and lamp in one unit which is removably held by the strap. Therefore, at the users option, the illumination device 7 can be removed and the timepiece converted to a conventional timepiece.

MODIFICATION

Figure 4:
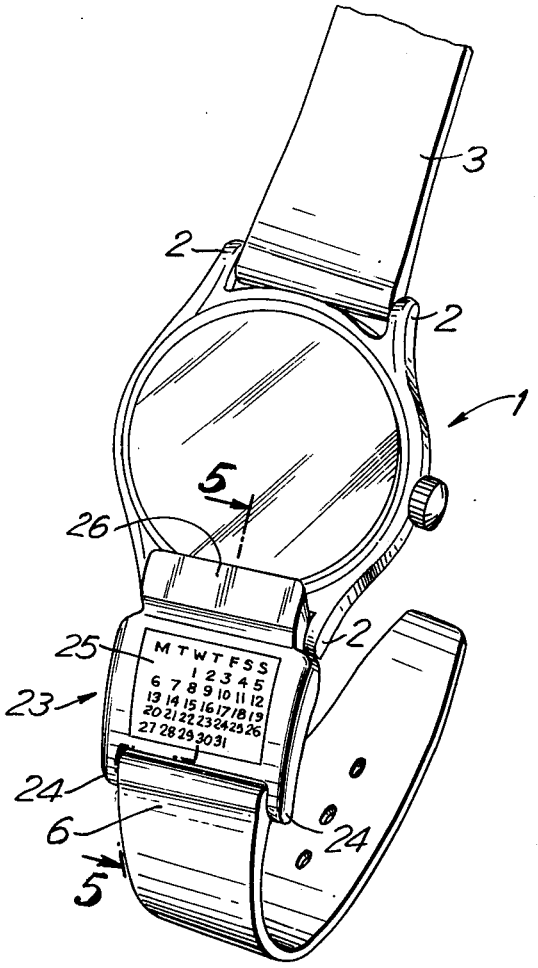

Referring to FIG. 4 of the drawing, a modified form of the invention is shown. The strap or watchband attachment ends 3, 6 and the timepiece 1 are constructed as in the preferred form of the invention. However, the illumination device in modified form is illustrated at 23 to include a pair of spaced attachment lugs 24 for connecting to the free attachment end 6 of the watchstrap using conventional "spring bars". Optionally, as before, the illumination device 23 may include a plastic cover for graphics which is also removable to insert the watch battery. Attachment device 23 includes an overhanging portion 26 extending beyond the point of attachment of the illumination device to the watchcase lugs 2.

Figure 5:
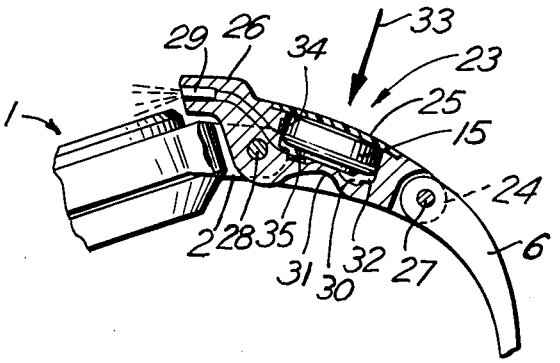

Referring to FIG. 5 of the drawing, the strap attachment end 6 is connected to the lugs 24 of the illumination device and the illumination device is connected to the lugs 2 of the watchcase by "spring bars" 27, 28 respectively. Disposed in the overhanging portion 26 of the illumination device is an incandescent bulb 29, disposed so as to illuminate the watch crystal and the timepiece face beneath it. The illumination device contains a cavity 30 containing a button cell 15 as before. The cell is held against the plastic insert 25 by means of a thin flexible wall portion 31. The cavity walls are shaped to permit movement of the cell within the cavity, by means of clearance space 32, when the plastic insert 25 is pushed in the direction of the arrow 33. A pair of stationary lamp terminals 34, 35 are disposed in the cavity 30 and connected by leads to incandescent lamp 29. When the wall 25 is depressed, the flexible cavity wall 31 permits movement of the battery within the cavity to close the circuit and light the lamp.

While there has been shown what is considered to be the preferred embodiment of the invention, and one modification thereof, it is of course understood that various other modifications mauy be made therein, and it is intended to cover in the appended claims all such modifications as fall within the true spirit and scope of the invention.

What is claimed is:

1. In a wristwatch having a case with connection means for attachment of a watchband and containing a timepiece face portion to be illuminated, and a watchband having first and second attachment ends, at least said first end being attached to said connection means, the improvement comprising a self-contained illumination device removably held by said second attachment end of the watchband and having an overhanging portion extending beyond said connection means and carrying a lamp arranged to illuminate said face portion, said illumination device defining a cavity, a battery disposed in said cavity having a pair of battery terminals, a pair of lamp terminals disposed in said cavity connected to said lamp a portion of the wall of said cavity being flexible and adapted to permit contact between at least one of said battery terminals and at least one of said lamp terminals when the illumination device is manually actuated.

2. The improvement according to claim 1, wherein said lamp terminal is disposed on the flexible wall and spaced from said battery terminal to contact same when the wall moves.

3. The improvement according to claim 1, wherein said cavity wall is shaped to permit movement of the battery when the illumination device is manually actuated through the flexible wall portion, and wherein said lamp terminal is disposed in the cavity to be contacted by said battery terminal when the battery moves.

4. The improvement according to claim 1, wherein said second attachment end of the watchband is connected to the connection means, and wherein the means to hold the illumination device on the watchband, comprises a longitudinal passage through the illumination device adapted to receive the watchband.

5. The improvement according to claim 1, wherein said second attachment end of the watchband is connected by a springbar to lugs disposed on the illumination device and wherein the illumination device is connected by a springbar to lugs disposed on the watchcase.

6. The improvement according to claim 1, wherein said illumination device includes a removable insert carrying selected graphic material.

7. In a wristwatch having a case containing a timepiece face portion to be illuminated and a watchband having attachment ends connected at connection means to opposite sides of said case, the improvement comprising a self-contained illumination device including a longitudinal passage adapted to receive one end of the watchband and to slide to a position adjacent to the watchcase, said illumination device having an overhanging portion extending over the watchcase beyond the connection means between the watchband and the watchcase and carrying a lamp arranged to illuminate said face portion, said illumination device defining a cavity containing a battery having a pair of battery terminals, a pair of lamp terminals disposed in the cavity connected to said lamp, a portion of the cavity wall being flexible and arranged to permit contact between at least one of said battery terminals and at least one of said lamp terminals when the illumination device is manually actuated to flex the cavity wall.

* * * * *